United States Patent [19]

Shiembob

[11] Patent Number: 4,566,700

[45] Date of Patent: Jan. 28, 1986

[54] ABRASIVE/ABRADABLE GAS PATH SEAL SYSTEM

[75] Inventor: Lawrence T. Shiembob, Rocky Hill, Conn.

[73] Assignee: United Technologies Corporation, Hartford, Conn.

[21] Appl. No.: 406,404

[22] Filed: Aug. 9, 1982

[51] Int. Cl.[4] ..... F01D 5/06; F01D 11/00

[52] U.S. Cl. ..... 277/53; 277/96.1; 415/174

[58] Field of Search ..... 277/96, 53; 415/174

[56] References Cited

U.S. PATENT DOCUMENTS

| | | | |
|---|---|---|---|
| 2,886,352 | 5/1959 | Krellner | 277/96.2 |
| 3,339,933 | 9/1967 | Foster | 277/53 |
| 3,519,282 | 7/1970 | Davis | 277/53 |
| 3,575,427 | 4/1971 | Lapac | 415/174 |
| 3,625,634 | 12/1971 | Stedfeld | 415/174 |
| 3,880,550 | 4/1975 | Corey et al. | 415/174 |
| 4,422,648 | 12/1983 | Eaton et al. | 415/174 |

*Primary Examiner*—Robert I. Smith

*Attorney, Agent, or Firm*—Charles E. Sohl

[57] ABSTRACT

An abradable/abrasive seal system having particular utility in gas turbine engines is described. The seal system includes an abrasive layer (40) which prevents direct interaction between components (30, 20) having relative motion and an abradable layer (43) which provides an effective degree of fluid sealing between the components.

17 Claims, 3 Drawing Figures

FIG. 1
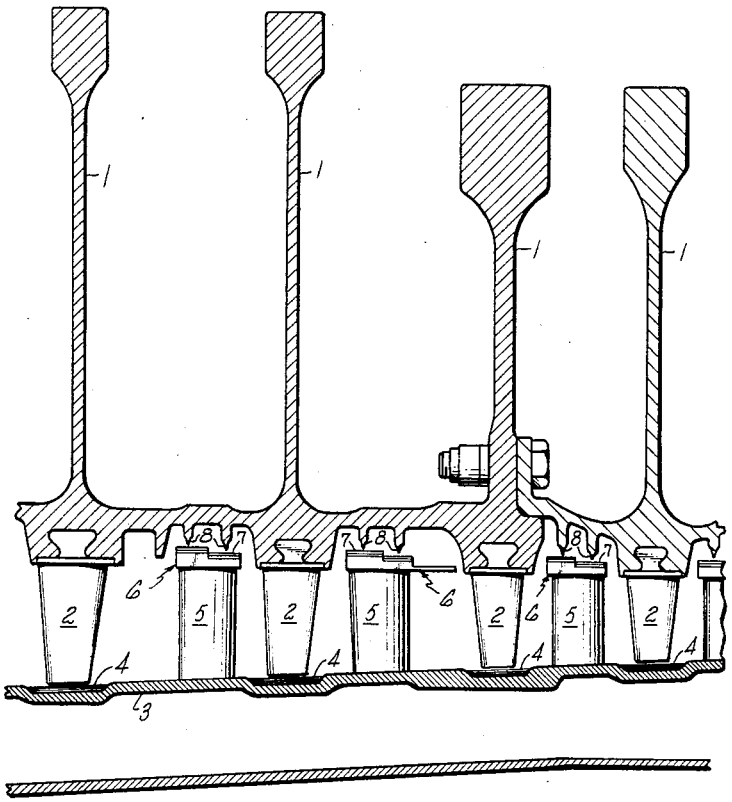
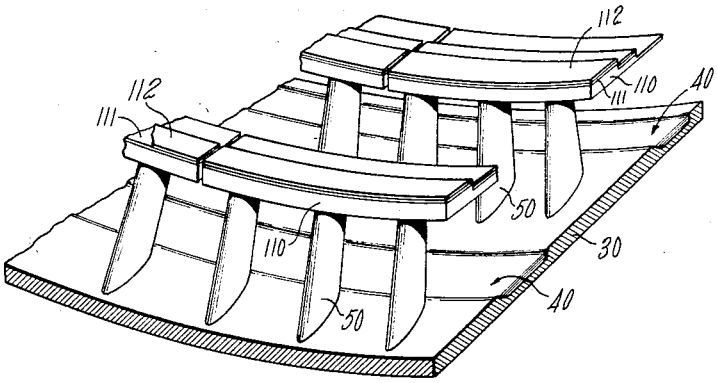
FIG. 3

ABRASIVE/ABRADABLE GAS PATH SEAL SYSTEM

DESCRIPTION

1. Technical Field

This invention relates to the field of seals used in rotating machinery to prevent leakage of fluids. This invention also relates to the field of abrasive seals which prevent direct interaction between moving components.

2. Background Art

Increasing energy costs have placed a premium on efficient operation of gas turbine engines. Efficiency can be increased by reducing leakage. Efficiency is, therefore, improved if tolerances and gaps between closely spaced moving parts are reduced. Substantial efforts have been expended in the art in the area of seal development. One general approach has been that which is termed abradable coatings. Such coatings are adapted to be readily worn away by moving components, thereby permitting the components to arrive at an efficient equilibrium relationship without extensive component wear. Typical of the art of abradable seals is that disclosed in U.S. Pat. Nos. 3,413,136 and 3,879,831. An alternative approach which has been less widely used, is the abrasive seal technique. In an abrasive type of seal, one moving component is coated with an abrasive material and the other relatively moving component is placed in close proximity thereto so that in operation, the abrasive cuts the other component leaving a minimum gap between the abrasive coated component and the uncoated component. Such a technique is described in U.S. Pat. No. 3,339,933.

Powder metallurgy techniques have been used to produce gas turbine engine seals; such techniques are described in U.S. Pat. Nos. 3,844,011 and 3,147,087. It is also known in the powder metallurgy art to produce articles having variable densities and containing substantial amounts of porosity.

U.S. Pat. No. 3,880,550 describes a solid metal seal for use in the turbine section of gas turbine engines having properties which vary through the seal thickness. The inner metal component is described as abrasive and the outer metal component is described as being abradable.

DISCLOSURE OF INVENTION

The present invention relates to a composite plasma sprayed seal having particular utility in gas turbine engines, particularly those of the axial flow type. Such engines include alternate rows of stationary vanes and moving blades with the blades being attached at the periphery of shaft mounted rotating disks.

The seal of the present invention includes an abrasive portion and an abradable portion. The seal is applied to the surface of an engine component where interaction occurs or is anticipated with another component. The abrasive portion is immediately adjacent to the component, and the abradable portion is disposed on the abrasive portion. The spacing between the components and the seal dimensions are arranged so that in normal operation, interaction occurs between the uncoated component and the abradable portion of the seal while in abnormal operation, the uncoated component contacts the abrasive component. Contact with the abrasive component prevents direct rubbing contact between the two components. The seal of the present invention has particular application in the compressor section of gas turbine engines where direct contact of titanium components must be avoided.

The foregoing, and other features and advantages of the present invention, will become more apparent from the following description and accompanying drawing.

BRIEF DESCRIPTION OF THE DRAWINGS

FIG. 1 is a partial cross section of a typical gas turbine engine compressor.

FIG. 3 is a perspective view showing the compressor vanes and the inner air seal.

BEST MODE FOR CARRYING OUT THE INVENTION

Figure 2:
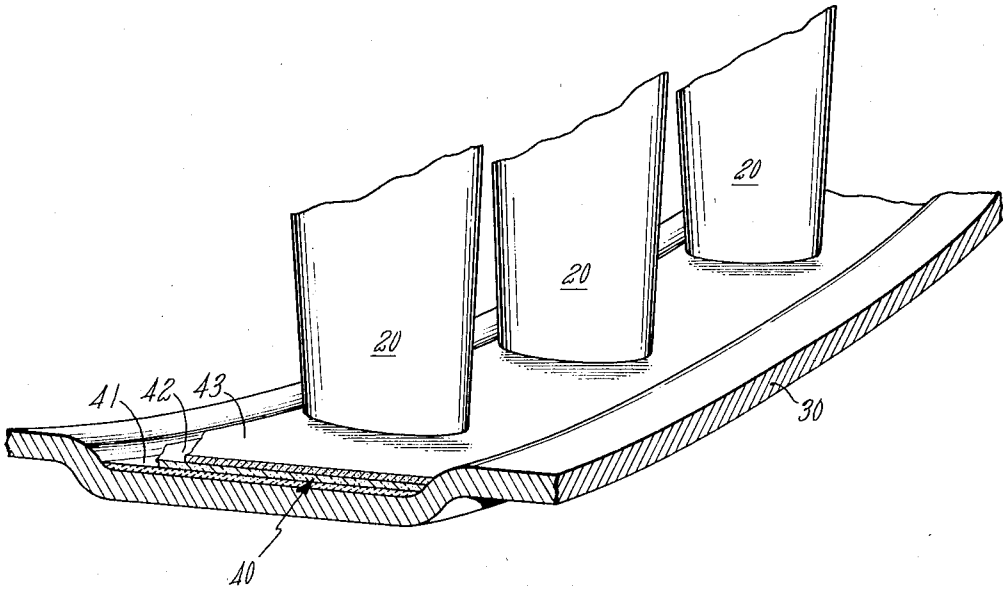
FIG. 2 is a perspective view showing the relationship between the compressor blades and the compressor case.

FIG. 1 illustrates a cross section part of the compressor section of a modern gas turbine engine. Components important to understanding the present invention include a plurality of rotatable disks 1 upon whose outer periphery are mounted a plurality of blades 2. The blades rotate within the inner case 3 and are closely spaced thereto. Minimum leakage between the blades and the inner case is achieved by the provision of a seal 4 (the outer air seal), mounted on the inner case.

Mounted within and upon the inner case 3 are a plurality of vanes 5 on whose inner, free ends 6 is mounted another seal 7 (the inner air seal) which is closely spaced to knife edges 8 mounted on extensions of the disks 1. In an alternate engine scheme, the disks do not have integral projections, but are separated by spacers upon which knife edges may be mounted. The knife edge 8 and inner air seal 7 cooperate to reduce leakage and improve efficiency.

The seals for which the present invention is particularly suited are located on the inner case 3 adjacent the free ends of the blades 2 (the outer air seal), and on the free ends 6 of the vanes 5 (the inner air seal). The seals of the present invention are preferably mounted on stationary substrates arranged to engage moving (uncoated) components.

FIG. 2 is a perspective view showing the relationship between the free ends of the blades 20 and the inner case 30, and showing the outer air seal 40 in more detail. Bonded to the case 30 is the seal 40 of the present invention. The embodiment shown is a three layer embodiment which includes an inner abrasive layer 41 bonded to the case 30, and intermediate layer 42 bonded to the abrasive layer 41 and an outer abradable layer 43 bonded to the intermediate layer 42.

FIG. 3 is a perspective view illustrating the application of another embodiment of the present invention to the inner air seals. The figure shows the inner case 30 upon which are mounted a plurality of vanes 50. Integral with the free ends of the vanes are platforms or inner air seal substrates 110 upon which the seal of the invention is located. Shown is the two layer embodiment which comprises an inner abrasive layer 111 bonded to the platforms and an outer abradable layer 112 bonded to the abrasive layer 111. In operation, knife edges (not shown) act to wear or abrade a groove into the seal to provide sealing.

For aerodynamic reasons, it is essential that leakage, the flow of gases between the blade tips and the case, or vane ends and disks or spacers, be minimized (hereafter "blade" will be used to generically indicate turbine parts which interact with seals). This problem is exacerbated by the dimensional changes which occur during engine operation resulting from temperature and stress.

In the prior art, abradable seal materials have been used. Such materials have a brittle friable nature which enables them to be worn away without significant wear or damage allowing engine operating clearances to be reduced and thereby, engine performance to be improved.

Another significant problem is encountered in turbine compressors. The compressor components are usually made of a titanium alloy. Titanium is a reactive metal and if rubbing occurs involving titanium components, sustained catastrophic combustion can result. Such combustion is encouraged by the environment in the compressor which can involve temperatures of up to about 900° F. (482° C.) and pressures of up to about 300 psi (2.064 MPa) which, in combination, offer an atmosphere conducive to combustion.

The present invention is a novel seal composition and structure which provides abradable characteristics during normal operating conditions and abrasive characteristics during abnormal operating conditions. In particular, during operating conditions resulting in blade excursion into the seal greater than design limits, the rotating blades contact an abrasive portion of the seal and the blades are worn away. This prevents rubbing contact of the blades with the engine casing, thus reducing chances for a fire.

The portion of the seal which is immediately adjacent the stationary component (the inner case or the vane ends) is of a rub resistant abrasive material. The term abrasive as used herein, describes a material which upon rubbing in contact with a titanium alloy component, will produce substantial wear of the titanium alloy component without the abrasive material undergoing significant wear. More particularly, the term abrasive will be used to denote those materials in which a wear interaction will result in at least 80% of the total wear occurring in the uncoated component and less than 20% of the total wear occurring in the abrasive material. For the abradable constituent, the reverse holds; that is, most of the wear occurs in the abradable component rather than the uncoated component. In particular, at least 60% of the wear in a given interaction will occur in the abradable component, and less than 40% will occur in the uncoated component. In the preceding definitions, uncoated means having no abrasive or abradable coating; protective layers or coatings having other primary functions may be present.

The seal assembly is fabricated by plasma spray deposition process. In such a process, the starting material, in powder form, is heated in a plasma so that at least surface softening, of the powder particles, occurs, and the heated powder is then projected at a high velocity against the substrate whereupon bonding occurs. A wide variety of abrasive materials can be employed including tungsten carbide, chromium carbide, silicon nitride, aluminum oxide, silicon carbide and mixtures thereof; particle sizes of from about −60 to +400 may be employed (U.S. Std. sieve sizes). Most particularly, however, abrasive compositions based on tungsten carbide and chromium carbide have been successfully employed and are preferred. In the case of the intermetallic abrasives such as chromium carbide and tungsten carbide, it will generally be found to be desirable to employ a metallic binder to ensure interparticle bonding and bonding of the particles to the substrate. The binder, if employed, is selected to be essentially nonreactive with the abrasive. In the case of tungsten carbide, a powder mixture comprising about 88 weight percent of tungsten carbide and about 12 weight percent of a cobalt binder has been utilized while in the case of the chromium carbide abrasive layer, a powder containing about 75 weight percent of $Cr_3C_2$ and about 25 weight percent of an alloy comprised of 80% nickel and 20% chrome has been utilized. It will often be found desirable to employ an initial bond coat to ensure that the abrasive material adheres to the substrate; such a bond coat may, for example, comprise the same or similar alloys to that employed as the matrix material or binder material in connection with the abrasive material. Other bond coats may be employed including alloys of the MCrAl type, where M is a material selected from the group consisting of iron, nickel, cobalt and mixtures thereof; Cr is chromium in an amount of from about 5% to 25% by weight; and Al is aluminum in an amount from about 5% to about 20% by weight. Reactive metals such as Y, La, Sc, Hf and the like may be added in amounts on the order of 0.1% to 2%.

The total seal thickness will usually range from 0.020 to 0.150 in. (0.051 cm to 0.381 cm), the thickness of the outer abradable portion will range from about 30% to about 80% of the total thickness. The outer, abradable, portion of the seal is also fabricated by plasma spraying. Abradable materials are those which are easily abraded or worn away; abradability can be provided by dispersing particles of a brittle material in a more ductile matrix. Such a brittle dispersed particle can be selected from the group consisting of graphite, mica, molybdenum disulfide, boron nitride, vermiculide, asbestos, diatemaceous earth, glass, rhyolite, bentonite, cordierite, and mixtures thereof. An amount of up to 65% by volume may be employed. In addition to these materials, abradability can be obtained by providing an amount (up to 70% by volume) of porosity in the material; such porosity can be obtained by varying the plasma spray parameters or by using larger particles or by co-spraying a material, such as a polyester or salt, which can be subsequently burned off or leached out of the deposited structure. The matrix preferably contains 5% to 25% Cr, 0% to 20% Al, 0% to 2% of a material selected from the group consisting of Y, Hf, La, Sc and mixtures thereof, balance selected from the group consisting of iron, nickel, cobalt, and mixtures of nickel and cobalt. The total amount of brittle materials and porosity should range from 30% to 70% by volume. U.S. Pat. No. 3,879,831 broadly describes abradable materials and is incorporated herein by reference.

Within the previously described bounds, a variety of embodiments may be employed. The simplest embodiment is a two-layer system having an inner abrasive portion adjacent the case, and an outer abradable layer. The abrasive is selected from the previously enumerated group and a thin initial bond coat may also be employed. The inner layer is free from intentional porosity. The thickness of the inner portion is from about 10% to about 50% of the total seal thickness. The outer abradable portion is comprised of a ductile matrix material containing a dispersed brittle material and/or porosity. In the two-layer approach, there is no intentional transition zone between the layers, although in a two-layer seal produced by a plasma spray process, a thin intermediate mixed layer might be present.

A more complex seal scheme is one in which there are three layers. The inner layer is the same as the inner layer in the two-layer scheme containing abrasive. Likewise, the outer layer is identical in composition to that previously described with respect to the two layer embodiment and is comprised of a metallic matrix containing an abradable material and/or intentional porosity. The distinctive feature in the three-layer scheme is the presence of an intentional intermediate layer. In one three-layer approach, the intermediate layer is less abradable than the abradable layer as a result of containing a reduced level of abradable material and/or porosity. In another three-layer approach, the intermediate layer contains a deliberate addition of abrasive material, but at a level less than that present in the inner layer. Finally, it is possible to produce a three-layer seal system with an intermediate layer in which the composition of the abrasive and abradability varies continuously within the intermediate layer.

It is possible to increase the number of layers with each layer having a slightly different composition than its neighbors, following the general scheme of having a high abrasive level at the inside of the seal, and high abradable level at the outside of the seal with both the abrasive content and abradable content varying through the thickness of the seal. In the limiting case, the abrasive and abradable contents can be varied continuously through the seal thickness resulting in a continuously graded seal.

The invention may be better understood through reference to the following example which is intended to be exemplary rather than limiting.

EXAMPLE

Samples simulating a compressor blade and case (as shown in previously discussed FIG. 2) were fabricated and tested. The case segment was made of titanium alloy AMS 4911, and the blade was made of titanium alloy AMS 4928. The case segment had a shallow groove corresponding to the projected rub path.

The grooved portion of the case segment was given the invention coating as follows:

1. An abrasive coating of 88% WC, 12% Co, 0.010 in. (0.025 cm) thick was plasma deposited using a METCO 7MB plasma torch operated at 40 volts, 800 amps, held 4.0 in. (10.16 cm) from the case. Powder of −200 to +350 mesh size was deposited while the torch was translated at 10 in. per minute (25.4 cm per minute) relative to the case;

2. An abradable coating of porous nichrome (80% Ni, 20% Cr), 0.073 in. (0.19 cm) thick was plasma deposited using a METCO 7MB plasma torch operated at 38 volts, 500 amps, held 4.5 inches (11.4 cm) away from the case. A powder mixture of 7 parts nichrome to 2 parts polyester was deposited and the polyester was burned out using a treatment of 2 hours at 1000° F. (538° C.) in air. The resultant structure contained about 50% porosity.

The seal thus applied comprised an abrasive coating about 0.010 in. (0.03 cm) thick, and an abradable coating about 0.073 in. (0.19 cm) thick.

This seal combination was evaluated by translating the (uncoated) blade at a rate of 66,000 feet (20,116.8 meters) per minute in a path parallel to the coated groove while advancing the seal toward the coating at 0.60 in. (1.52 cm) per minute until contact was made. Relative motion was continued until the blade had advanced 0.330 in. (0.84 cm) into the coated substrate. The sample condition was periodically evaluated. It was observed that when the blade sample was advancing into the abradable seal portion, the ratio of blade wear to seal wear was about 10:90, but that when the sample blade encountered the abrasive portion, the blade:seal wear ratio changed to more than 99:1 and that no direct titanium to titanium wear occurred, i.e. the uncoated blade was abraded and the integrity of the abrasive coated case was maintained.

I claim:

1. In an apparatus which operates under conditions where titanium combustion can occur, and which includes closely spaced titanium components between which relative motion occurs and between which clearances and fluid flow must be minimized while direct rubbing contact must be avoided, the improvement which comprises:

providing on one component a composite plasma sprayed sealing coating which includes a plasma sprayed abrasive layer on said component and a plasma sprayed abradable layer on said plasma sprayed abrasive layer, wherein, during rubbing contact between an uncoated component and the abrasive layer, greater than 80% of wear occurs in the uncoated component and less than 20% occurs in the abrasive layer while, during rubbing contact between an uncoated titanium alloy component and an abrasive layer greater than 60% of the resultant wear occurs in the abradable layer and less than 40% occurs in the uncoated component, with the thicknesses of the abrasive and abradable layers and the component clearances being such that in normal operation, the uncoated component encounters and abrades the abradable layer without being significantly abraded itself, while under abnormal operating conditions the uncoated component encounters and is abraded by the abrasive layer and does not directly contact the coated component substrate.

2. A gas turbine engine compressor which includes:

(a) at least one a stationary component;

(b) a plasma sprayed abrasive coating affixed to the stationary component;

(c) a plasma sprayed abradable coating affixed to the abrasive coating; and (d) a moving titanium alloy component spaced so that in normal operation, said moving component interacts with said plasma sprayed abradable layer while in abnormal operation, said moving component interacts with said plasma sprayed abrasive coating and does not interact with said stationary component.

3. A method for providing fluid sealing between two relatively moving apparatus components, at least one of which is comprised of a titanium alloy, while avoiding detrimental rub interactions which comprises:

applying an adherent abrasive coating to one component by plasma spraying;

applying an adherent abradable coating to the abrasive coating by plasma spraying;

so that in normal operation, sealing is provided by interaction of the uncoated component with the abradable coating while detrimental rub interaction between the components, during abnormal operation, is prevented by the abrasive coating.

4. Apparatus as in claims 1, 2 or 3 in which said abrasive layer includes, as its primary abrasive constituent a material selected from the group consisting of tungsten carbide, chromium carbide, aluminum oxide, silicon nitride, silicon carbide and mixtures thereof.

5. Apparatus as in claims 1, 2 or 3 which further includes a metallic bond coat between the substrate component and the abrasive layer.

6. Apparatus as in claims 1, 2 or 3 which further includes an intermediate layer between the abrasive layer and the abradable layer.

7. Apparatus as in claim 1 in which the abradable layer includes intentional porosity.

8. Apparatus as in claim 2 in which the abradable layer includes intentional porosity.

9. Apparatus as in claim 3 in which the abradable layer includes intentional porosity.

10. A plasma sprayed composite coating for application to a substrate, having a combination of abradable and abrasive properties, which comprises:

a. an inner layer adjacent the substrate having an abrasive nature comprised of an abrasive agent selected from the group consisting of WC and $Cr_3C_2$, said abrasive agent being located in a metallic matrix;

b. an outer layer adjacent the free surface of the coating having an abradable nature comprised of a material selected from the group consisting of brittle dispersed particles including graphite, mica, molybdenum disulfide, boron nitride, vermiculite, asbestos, diatomaceous, glass, rhyolite, bentonite, cordierite and mixtures thereof and porosity wherein the total seal thickness is from about 0.020 to about 0.150 in. and the abrasive layer comprises 10–20% of the seal thickness and the outer abrasive layer comprises 30–80% of the seal thickness.

11. A plasma sprayed composite coating for application to a substrate, having a combination of abradable and abrasive properties, which comprises:

a. an inner layer adjacent the substrate having an abrasive nature comprised of an abrasive agent selected from the group consisting of WC and $Cr_3C_2$, said abrasive agent being located in a metallic matrix;

b. an intermediate layer between the abrasive layer and the abradable layer having an abradable nature which is less than that of the outer abradable layer;

c. an outer layer adjacent the free surface of the coating having an abradable nature comprised of a material selected from the group consisting of brittle dispersed particles including graphite, mica, molybdenum disulfide, boron nitride, vermiculite, asbestos, diatomaceous, glass, ryolite, bentonite, coriderite and mixtures thereof and porosity wherein the total seal thickness is from about 0.020 to about 0.150 in. and the abrasive layer comprises 10–20% of the seal thickness and the outer abrasive layer comprises 30–80% of the seal thickness.

12. A coating as in claim 11 further including a bond coat between the substrate and the abrasive layer.

13. A plasma sprayed composite coating for application to a substrate, having a combination of abradable and abrasive properties, which comprises:

a. an inner layer adjacent the substrate having an abrasive nature comprised of an abrasive agent selected from the group consisting of WC and $Cr_3C_2$, said abrasive agent being located in a metallic matrix;

b. an intermediate layer between the abrasive layer and the abradable layer having an abrasive nature which is less than that of the inner abradable layer;

c. an outer layer adjacent the free surface of the coating having an abradable nature comprised of a material selected from the group consisting of brittle dispersed particles including graphite, mica, molybdenum disulfide, boron nitride, vermiculite, asbestos, diatomaceous, glass, ryolite, bentonite, coriderite and mixtures thereof and porosity wherein the total seal thickness is from about 0.020 to about 0.150 in. and the abrasive layer comprises 10–20% of the seal thickness and the outer abrasive layer comprises 30–80% of the seal thickness.

14. A coating as in claim 13 further including a bond coat between the substrate and the abrasive layer.

15. A plasma sprayed composite coating for application to a substrate, having a combination of abradable and abrasive properties, which comprises:

a. an inner layer adjacent the substrate having an abrasive nature comprised of an abrasive agent selected from the group consisting of WC and $Cr_3C_2$, said abrasive agent being located in a metallic matrix;

b. an intermedite layer between the abrasive layer and the abradable layer having an abrasive nature which is less than that of the inner abradable layer, and having an abradable nature which is less than that of the outer abradable layer;

c. an outer layer adjacent the free surface of the coating having an abradable nature comprised of a material selected from the group consisting of brittle dispersed particles including graphite, mica, molybdenum disulfide, boron nitride, vermiculite, asbestos, diatomaceous, glass, ryolite, bentonite, coriderite and mixtures thereof and porosity wherein the total seal thickness is from about 0.020 to about 0.150 in. and the abrasive layer comprises 10–20% of the seal thickness and the outer abrasive layer comprises 30–80% of the seal thickness.

16. A coating as in claim 15 further including a bond coat between the substrate and the abrasive layer.

17. A plasma sprayed composite coating for application to a titanium substrate, having a combination of abradable and abrasive properties, which comprises:

a. a metallic bond coat adjacent the substrate;

b. an abrasive inner layer adjacent the bond coat comprising WC particles in a cobalt matrix;

c. an abradable outer layer adjacent the free surface of the coating comprised of Ni-Cr alloy material containing substantial intentional porosity.

* * * * *